US006881910B2

(12) United States Patent
Fox

(10) Patent No.: US 6,881,910 B2
(45) Date of Patent: Apr. 19, 2005

(54) SECURITY DEVICE FOR ELECTRICAL CORDS

(76) Inventor: Christopher Fox, 1621 SW. 2nd Ave., Pompano Beach, FL (US) 33060

( * ) Notice: Subject to any disclaimer, the term of this patent is extended or adjusted under 35 U.S.C. 154(b) by 0 days.

(21) Appl. No.: 10/699,200

(22) Filed: Oct. 31, 2003

(65) Prior Publication Data

US 2004/0140184 A1 Jul. 22, 2004

Related U.S. Application Data

(60) Provisional application No. 60/422,835, filed on Oct. 31, 2002.

(51) Int. Cl.[7] ..... H01R 19/40
(52) U.S. Cl. ..... 200/51.11; 200/43.22
(58) Field of Search ..... 200/43.11, 43.22, 200/51.02, 293, 50.01, 50.04, 50.12; 174/50, 50.52, 50.55, 51, 52.1, 58, 65 R

(56) References Cited

U.S. PATENT DOCUMENTS 3,846,598 A * 11/1974 Mucsi ..... 200/51.09
4,063,110 A * 12/1977 Glick ..... 307/112
4,593,162 A * 6/1986 Rochette ..... 200/51.09
4,647,735 A * 3/1987 Sicher ..... 200/43.08
4,975,550 A * 12/1990 Panchisin ..... 200/43.08
5,486,664 A * 1/1996 Lamp et al. ..... 200/297
5,488,208 A * 1/1996 Seewald ..... 200/43.22
5,592,032 A * 1/1997 Keizer et al. ..... 307/116
5,731,763 A * 3/1998 Herweck et al. ..... 340/825.69

* cited by examiner

*Primary Examiner*—Elvin Enad
*Assistant Examiner*—Lisa Klaus

(57) ABSTRACT

A security device for electrical cords is disclosed, including a housing having a base and a plurality of side members, an electrical output operatively engaged to a support, the support integrally connected to the housing, an electrical input operatively engaged to the housing and electrically connected to the electrical output, a plurality of securement grooves for securing at least one slidable plate, a switch having a first position and a second position to control electrical flow between the electrical input and the electrical output, and a lock member to selectively lock the switch into one of the first position or said second position.

2 Claims, 3 Drawing Sheets

SECURITY DEVICE FOR ELECTRICAL CORDS

CROSS-REFERENCE TO RELATED APPLICATION

This application claims the benefit of U.S. Provisional Application Ser. No. 60/422,835, filed on Oct. 31, 2002, entitled SECURITY DEVICE FOR ELECTRICAL CORDS.

TECHNICAL FIELD

This invention relates generally to security devices for electrical cords. More particularly, the present invention relates to a security device for electrical cords that prevents access to electrical devices when the security device is engaged.

BACKGROUND OF THE INVENTION

Known devices for providing security to prevent unauthorized individuals from using electrical appliances have included means such as large expensive lockable coverings for the entire appliance or switch or other devices built into the appliance itself. These prior devices have tended to be bulky and hard to handle, or relatively expensive and complicated. Furthermore, in appliances not initially provided with some type of security at the factory, the addition of a security device was extremely costly or difficult and usually involved tools or knowledge of the appliance not readily available.

SUMMARY OF THE INVENTION

The present invention eliminates the above-mentioned needs for a security device for electrical cords and method for using the same that is not overly bulky or expensive and restricts access to electrical appliances in a simplistic and effective manner, as well as a method of utilizing the same.

In accordance with the present invention, there is provided a security device for electrical cords, including a housing having a base and a plurality of side members, an electrical output operatively engaged to a support, the support integrally connected to the housing, an electrical input operatively engaged to the housing and electrically connected to the electrical output, a plurality of securement grooves for securing at least one slidable plate, a switch having a first position and a second position to control electrical flow between the electrical input and the electrical output, and a lock member to selectively lock the switch into one of the first position or said second position.

The present invention is additionally directed to a method for securing an electrical cord of an appliance, the method comprising the steps of inserting an electrical cord of an electrically powered device into an electrical output of a security device having a housing, passing the electrical cord into the security device between at least one plate positioned in a groove within said housing and the housing, securing a cover to the housing to prevent unauthorized access to the electrically powered device.

DETAILED DESCRIPTION OF THE PREFERRED EMBODIMENT

Figure 1:
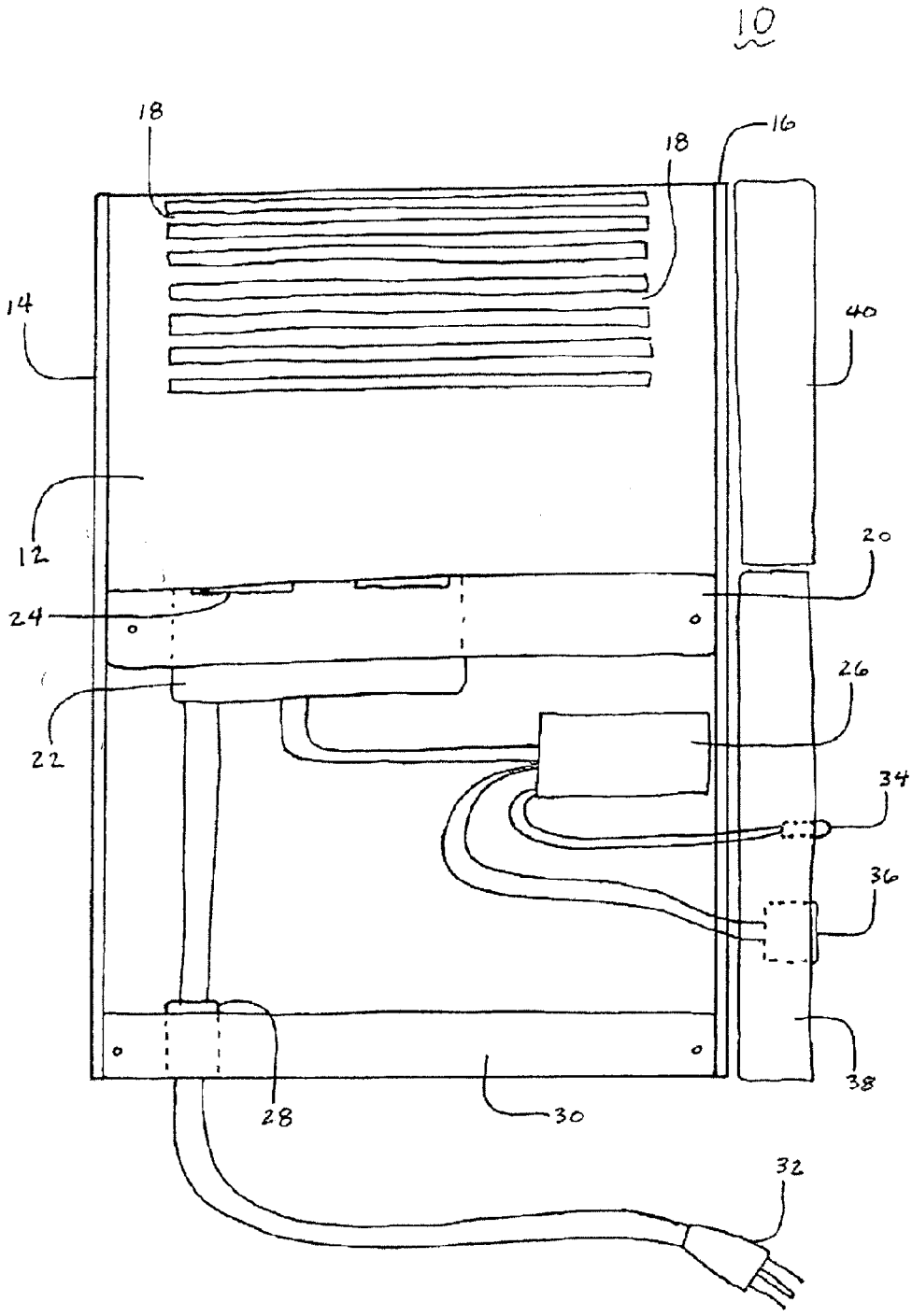
FIG. 1 is a top view illustration of the preferred embodiment of the present invention, with cover members removed.

Referring now to FIG. 1, a preferred embodiment of the present invention is illustrated as security device 10. Security device 10 includes base 12 and side members 14 and 16 to form a U-shaped arrangement. Side members 14 and 16 can be formed from the same continuous piece of material that forms base 12. At one end of base 12, grooves are formed to receive plates 17, as shown in FIG. 2 and discussed below.

Additionally, security device 10 includes power outlet support 20. Power outlet support 20 can be a separate piece, or can be formed from the same continuous piece of material that forms base 12. Power outlet support 20 supports power-providing unit 22, which has at least one power outlet 24 for receiving a plug 50 (illustrated in FIG. 2) from an electrically powered device.

Power providing-unit 22 is electrically connected to an electricity providing line 28 that includes a plug end 32. A user can electrically connect plug end 32 to an outlet (not shown) to provide electrical power as an electrical input to power-providing unit 22.

Figure 2:
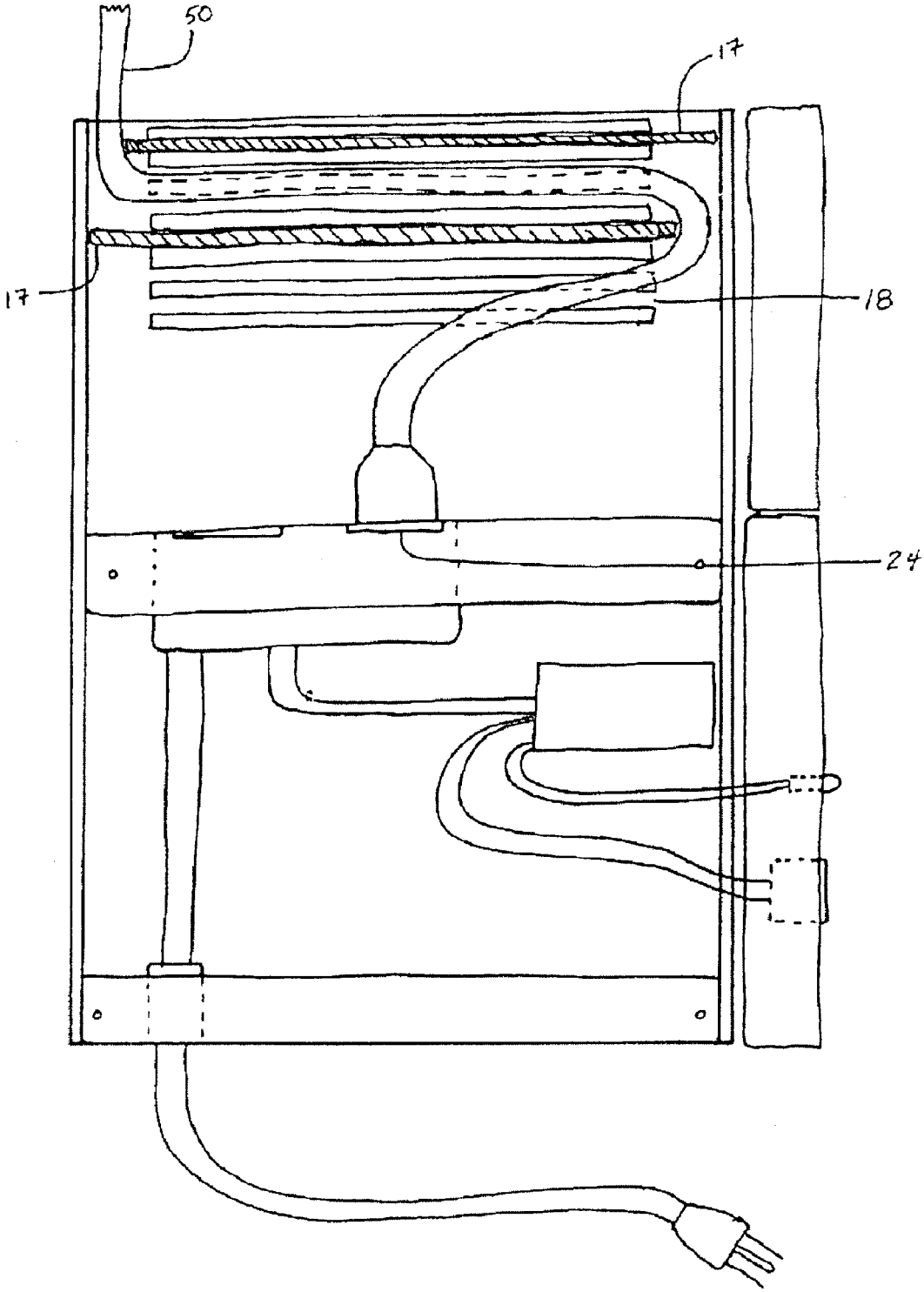
FIG. 2 is a top view illustration of the present invention of FIG. 1 in operation, with cover members removed.

Power-providing unit 22 is an electrical output for and supplies power to a plug, such as plug 50 shown in FIG. 2, of an electrically powered device and additionally provides electricity to switch 26. Switch 26 operates to turn on or off the electrical power provided by power-providing unit 22 to an electrically powered device. Switch 26 is further coupled to an indicator light 34. Indicator light 34 provides the user with an indication of a power condition for security device 10. For example, a glowing indicator light 34 can be used to inform the user that power-providing unit 22 is supplying power to an electrically powered device. Switch 26 is further coupled to lock 36. Lock 36 serves to trip switch 26 to either prevent or permit electricity to flow through the system of security device 10 to an electrically powered device.

Lock 36 and indicator light 34 can be positioned on a cover member 38. Cover member 38 is used to prevent access to the contents of security device 10. An additional cover member 40 can be used to proved separate access to at least one power outlet 24.

As illustrated in FIG. 2, plug 50 from an electrically powered device is operationally engaged to at least one power outlet 24. Plug 50 passes between plates 17, which are positionable in any of grooves 18, so that plug 50 is prevented from being removed from security device 10. Plates 17 are sufficient in length to create a width sufficient to accommodate the cord of plug 50, but not the plug itself. This prevents removal of plug 50 from the interior of security device 10 when cover 40 is positioned over plates 17 and secured. Cover 40 can be secured by a locking mechanism (not shown) or other means well known in the art. In this fashion, for example, a parent can prevent a child from removing plug 50 from an unpowered security device 10 to attempt to power the desired electrical device, such as a video game system. Power to the electrical device can only be provided by the holder of the key or code for lock 36, thus preventing or permitting use.

Figure 3:
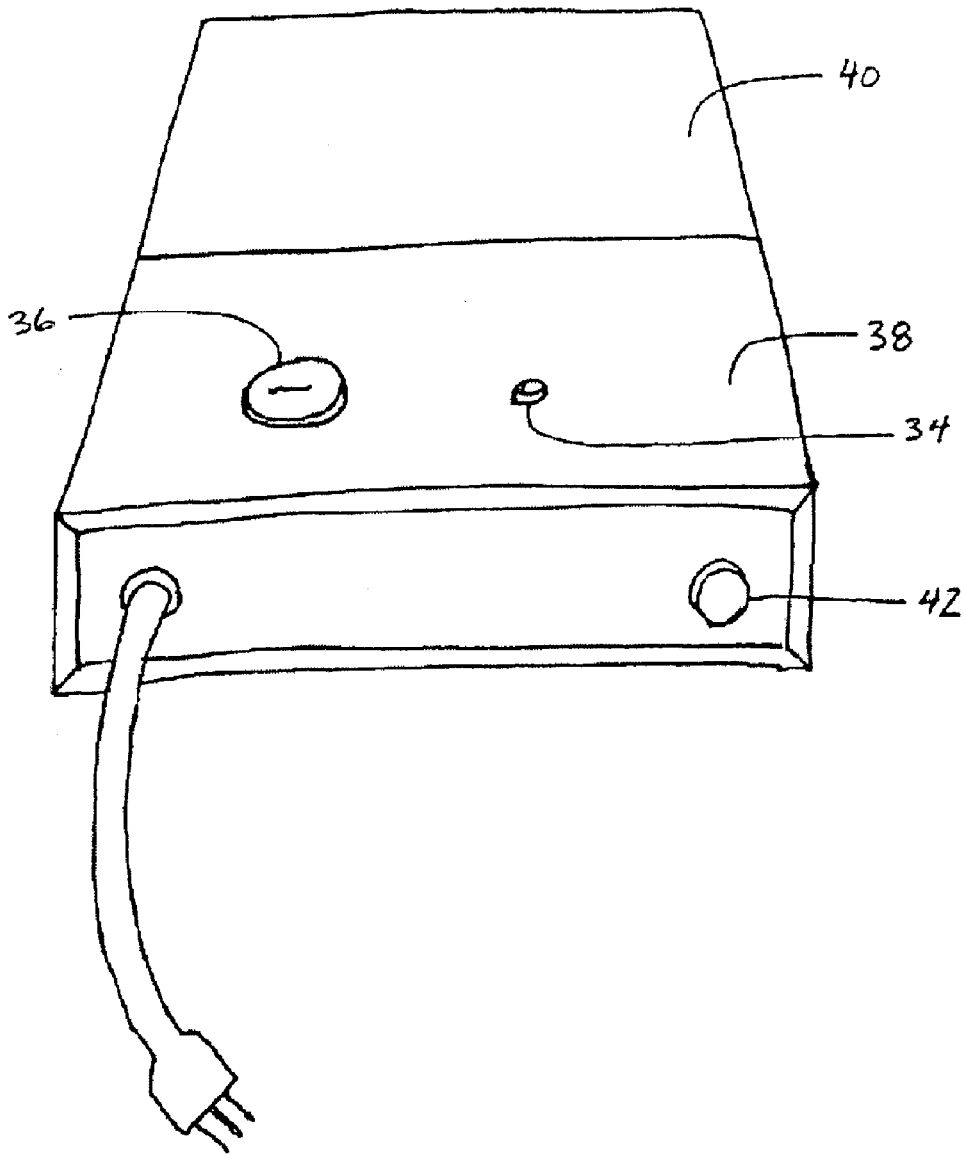
FIG. 3 is an isometric view of an end of the present invention of FIG. 1, with cover members in place.

FIG. 3 illustrates security device 10 with cover members 38 and 40 in position. As shown, a fuse 42 can be included to prevent an electrical overload from occurring.

Although only a few exemplary embodiments of the present invention have been described in detail above, those skilled in the art will readily appreciate that numerous modifications are to the exemplary embodiments are possible without materially departing from the novel teachings and advantages of this invention. Accordingly, all such modifications are intended to be included within the scope of this invention as defined in the following appended claims.

What is claimed is:

1. A security device for electrical cords, comprising:

a housing having a base and a plurality of side members;

an electrical output operatively engaged to a support, said support integrally connected to said housing;

an electrical input operatively engaged to said housing and electrically connected to said electrical output;

a plurality of securement grooves for securing at least one slidable plate;

a switch having a first position and a second position to control electrical flow between said electrical input and said electrical output; and a lock member to selectively lock said switch into one of said first position or said second position.

2. A method for securing an electrical cord of an electrically powered device, said method comprising the steps of:

inserting an electrical cord of an electrically powered device into an electrical output of a security device having a housing;

passing said electrical cord into said security device between said housing and at least one plate positioned in a groove within said housing;

securing a cover to said housing to prevent unauthorized access to said electrically powered device.

* * * * *